United States Patent [19]

Hullihan

[11] Patent Number: 4,662,188

[45] Date of Patent: May 5, 1987

[54] PORTABLE COOLER OR ICE CHEST

[76] Inventor: Michael J. Hullihan, 7219 Sunlight La., Houston, Tex. 77095

[21] Appl. No.: 831,712

[22] Filed: Feb. 21, 1986

[51] Int. Cl.[4] ..... F25D 3/08

[52] U.S. Cl. ..... 62/372; 62/457

[58] Field of Search ..... 62/457, 372; 190/16; 220/20

[56] References Cited

U.S. PATENT DOCUMENTS

| | | | |
|---|---|---|---|
| 2,614,397 | 10/1952 | Petty | 62/457 X |
| 4,018,585 | 4/1977 | Loratto | 62/372 |
| 4,336,883 | 6/1982 | Krug et al. | 62/457 X |

*Primary Examiner*—Lloyd L. King
*Attorney, Agent, or Firm*—Neal J. Mosely

[57] ABSTRACT

The specification discloses a portable cooler, storage container or icechest, in the configuration of a briefcase or attache case, and the like. The portable cooler, storage container or icechest is defined by outer side, rear, front, top and bottom walls. The outer rear wall has four separately spaced appendages affixed thereon. Separate inner side, rear, front, top and bottom walls are thermally insulated from the outer walls to define a storage compartment. A lid is defined is by outer side, top and front walls separated by an insulating medium from inner side, top and front walls. The lid is designed with a tongue while the storage container has a groove on their respective side and top walls. A hinging means attaches the lid to the storage container on which is also affixed a latching means, again on the lid and another on the storage container. To enable excess accumulation of moisture passage from the storage compartment, a drainage means extends through the cooler side. To enable easy carry of the cooler, a transporting means is affixed to the front wall of the cooler.

2 Claims, 3 Drawing Figures

PORTABLE COOLER OR ICE CHEST

FIELD OF THE INVENTION

This present invention relates to a portable cooler, storage container or icechest, commodity containing device.

BACKGROUND OF THE INVENTION

Present portable coolers, storage containers or icechest vary in their outside dimensions, depending on the capacity of the storage compartment contained therein. Predominately the measurements are either in gallons or more frequently in quart capacity. Until fairly recently, present devices were basically all constructed with large storage compartments. However, storage space has become more limited and convenience factors have dictated that devices of such, with smaller outside dimensions be designed. Many are available now with smaller dimensions, but are also limited in their use. In having to choose which present device is sufficient to accomodate the varied needs each individual has, created yet another problem. One device is either too large for the particular situation or the other is too small. For example, to carry six beverage cans in a cooler designed to hold twenty four or more is inconvenient and difficult to handle for most people. On the other hand, if you have a cooler which can hold only six beverage cans, and the needs calls for a capacity device to hold twenty four, the cooler is useless altogether. Such a situation has caused most people to purchase two or more of the present devices that are available in order to meet their requirements. This unnecessary expense could be avoided with the present invention, while the various needs the average individual has will still be met in a single device.

Accordingly, a need has arisen for a convenient and practical portable cooler, storage container or icechest, which has a storage compartment of versatile capacity to meet the overall needs of most individuals while maintaining outside dimensions that are easy to transport and store. The present invention relates to the utility and improvements made on applicants prior applications for the original design, now Ser. Nos. 730,302 filed May 3, 1985 and 769,880 filed Aug. 27, 1985 which are still pending at this time. The present invention will provide a multifunctional portable cooler, storage container or icechest that can be used in lieu of several present devices in meeting the varied needs of people ina single device, thereby eliminating the cost of owning several present devices. The present invention has the usefulness and flexibility found in no single present device.

SUMMARY OF THE INVENTION

The present invention is directed to a portable cooler, storage container or icechest, which is configurated to provide the convenience of easy carry, storage whether in use or not, and the flexibility to accomodate the varied needs individuals have. By its construction, the present invention is especially well adapted for use as a small dimensioned cooler with the capacity and capabilities of the much larger dimensioned devices. The present invention will not be as restricted to a particular use as is the present devices, whether small or large.

In accordance, the present invention, a portable cooler, storage container or icechest in the configuration of a briefcase or attache case, or the like, is dimensioned as a multifunctional cooler. The cooler is defined by outer side, rear front, top and bottom walls. The outer rear wall has four separately spaced appendages thereon. Separate inner side, rear, front, top and bottom walls are thermally insulated from the outer walls to define a storage compartment. Outer side, front and top walls, separated from inner side, front and top walls by an insulating medium defines a lid. The lid attaches to the cooler by a hinging means to thermally insulate it. Both the lid and the storage container have a latching means affixed thereon. The storage container also has a transporting means affixed thereon as well as a drainage means extending therefrom.

BRIEF DESCRIPTION OF THE DRAWINGS

For a more complete understanding of the present invention and for further objects and advantages thereof, reference is now made to the following description taken in conjunction with the accompanying drawings in which.

DESCRIPTION OF THE PREFERRED EMBODIMENT

Figure 1:
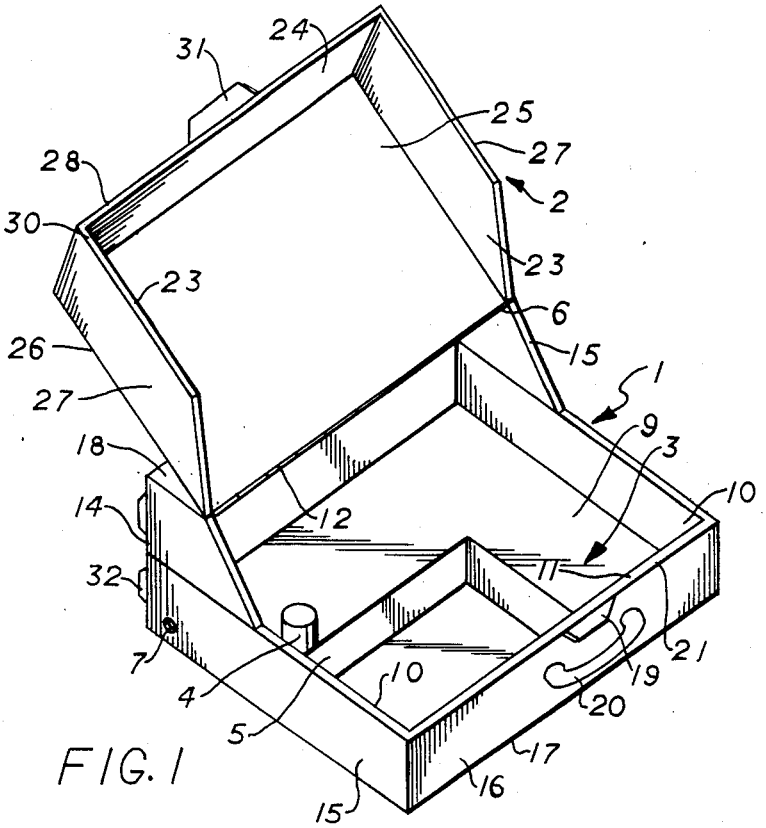
FIG. 1 is a perspective view of the preferred embodiment of the invention.

FIG. 1 illustrates the preferred embodiment of a portable cooler 1 as it appears with the lid 2 open. Cooler 1 has a waterproof storage compartment 3 for storing beverage containers 4, food or various other items and an accessory tray 5 which is removeable. Ice or other ice substitutes may be placed in the storage compartment 3 to keep the beverage containers 4 cold as well as other articles such as food or the like. Storage compartment 3 is thermally insulated from the outer walls of cooler 1 by an insulating medium 13 as will be described in greater detail later.

A lid 2 is attached to cooler 1 by a hinging means 6 making it possible to thermally insulate the storage compartment 3. As evident in FIG. 1, the storage compartment 3 is dimensioned to allow for the accumulation of moisture on the rear wall of the cooler 1 when being transported, wherein a drainage means 7 on the cooler 1 extends through the side wall of the cooler 1. As best shown in FIG. 1 storage compartment 3 is defined by an inner rear wall 8 (see FIG. 3) an inner bottom wall 9, inner side walls 10, an inner front wall 11, and an inner top wall 12. Inner walls 8, 9, 10, 11, and 12 are substancially perpendicular to one another and define a waterproof storage compartment 3. Storage compartment 3 is formed inside the exterior of cooler 1 so that the walls of the storage compartment 3 are thermally insulated from the exterior of cooler 1 by an insulating medium 13 interposed therebetween, and will be described better in FIG. 3 later. The thermally insulated storage compartment 3 is designed essentially for the cold storage of ice, food and cold beverages as well as other articles.

The exterior of cooler 1 is defined by an outer rear wall 14, outer side walls 15, an outer front wall 16, an outer bottom wall 17 and outer top wall 18. Outer bottom wall 17 is not visible in FIG. 1, but can be seen better in FIG. 3, which will be discussed later. Exterior outer walls 14, 15, 16, 17 and 18 are separated from storage compartment 3 inner walls 8, 9, 10, 11, and 12 by an insulating medium 13 and are integrally formed in to define a cooler 1. A drainage means 7 extending through the cooler 1 is also integrally formed in. The outer front wall 16 has a latching means 19 affixed thereon as well as a transporting means 20 also affixed. To allow for a tight fit when closing the cooler 1, a groove 21 opening upwardly and integrally formed in, extends along the side walls and front wall of the cooler 1.

Figure 2:
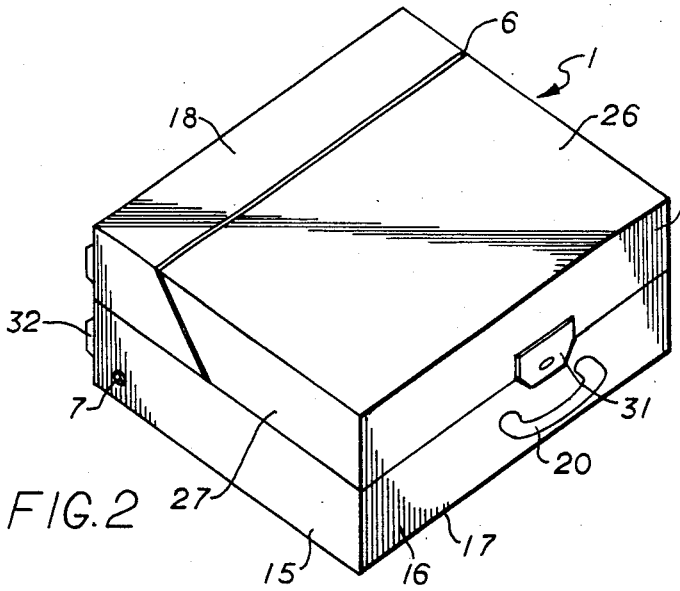
FIG. 2 is a plan view of the preferred embodiment of the invention.
Figure 3:
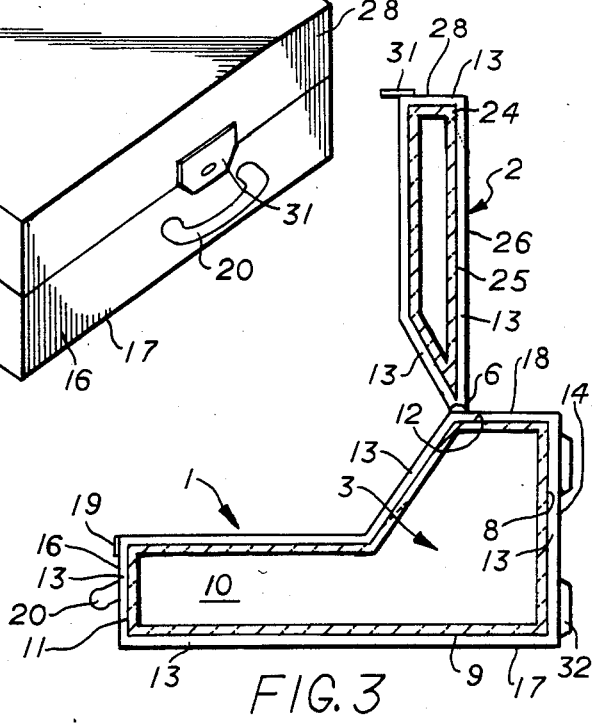
FIG. 3 is a side section view of the preferred embodiment of the invention.

The lid 2 is defined by inner side walls 23, an inner front wall 24, and an inner top wall 25, spaced separate from the outer side walls 27, an outer front wall 28 and an outer top wall 26 by an insulating medium 13, and integrally formed in. The lid 2 has a tongue 30 facing downward and integrally formed in, extending along the front and side walls of the underside of the lid 2. A hinging means 6 attaches the lid 2 to the cooler 1 thereby allowing the lid 2 an upward anddownward movement, wherein the tongue 30 of the lid 2 and the groove 21 of the cooler 1 will engage tightly to provide good thermal insulation within the storage compartment 3. To further insure a tight seal of the cooler 1, the lid 2 has a latching means 31 affixed on the lid 2 and when lid 2 is closed will engage with latching means 19 on the cooler 1 and further provide for good thermal insulation within the storage compartment 3. Cooler 1 has four separately spaced and integrally formed in appendages 32 on the rear wall of the cooler 1 to allow cooler 1 to be placed in an upright position without tipping over. Looking now at FIG. 2 and showing the previously defined cooler 1 laying flat on the bottom wall 17 of the cooler 1 with the lid 2 in a closed position. As can be seen in this view, the tongue 30 and the groove 21 are engaged providing good thermal insulation for the storage compartment 3. The upper and lower latching means 19 and 31, are likewise engaged securing the lid 2 to the cooler 1. Also visible is the hinging means 6 on the cooler 1. Turning to FIG. 3 as was referred to in previous figures, shows the insulating medium 13 separating the inner rear wall 8, an inner bottom wall 9, inner side walls 10, inner front wall 11 and inner top wall 12 from separate outer rear wall 14, outer bottom wall 17, outer side walls 15, outer front wall 16, and an outer top wall 18, thereby defining a storage compartment 3, the walls being integrally formed in. The lid 2 is defined by outer top wall 26, outer front wall 28, and outer side walls 27 separated by an insulating medium 13 from separate inner top wall 25, inner front wall 24 and inner side walls 23 which are integrally formed in.

The portable cooler 1 may be constructed from plastic by injection molding the exterior and inner storage compartment 3 separately. An exemplary material for the cooler 1 exterior is polyethylene, available from USI Chemical or Phillips Petroleum. For the storage compartment 3 a similar polyethylene which meets USDA and FDA standards can be used. The storage compartment 3 may be sonically welded to the exterior of the cooler 1 to form the complete structure. The same materials and techniques may be used to form the lid 2.

By its construction, the present invention will offer the advantages in a single portable cooler, storage container, or icechest that can not be found in any other present device. It is designed to be a large capacity cooler, in a small dimensioned exterior, thereby providing a multifunctional cooler to use for about every need encountered.

Although particular embodiments of the invention have been described herein, it will be understood that the invention is not limited to the embodiments disclosed, but is capable of rearrangement, modification and substitution of parts and elements without departing from the spirit and scope of the invention.

What is claimed is:

1. A portable cooler comprising:

an outer shell having side, front, rear, top and bottom walls defining a storage container, said top wall extending a short predetermined distance from said rear wall with the remainder portion of the top being open, a lid comprising a separate outer top wall with outer side walls and an outer front wall extending downwardly therefrom, said lid being positioned with its top wall abutting said container top wall and extending across and closing said open top portion with the front and side walls thereof closing against said container front and side walls respectively, said lid and said container side walls and front walls having a tongue in one of said walls and groove in the other of said walls to provide a tongue in groove seal when closed, latch means on said lid and said container front walls for securing said lid closed, means for transporting said storage container affixed to said container front wall, four separately spaced appendages on said container rear wall and integrally formed therein;

an inner shell having side, front, rear, top and bottom walls defining a storage compartment, said storage compartment wall being spaced from said storage container walls, an insulating medium filling the space between the walls of said storage container and said storage compartment, the front and side walls of said storage compartment and said storage container and said insulating medium terminating along a common edge and being secured together to provide a waterproof compartment, said lid having an inner shell portion comprising a separate inner top wall with inner side walls and an inner front wall extending downwardly therefrom, said lid inner shell walls being spaced from said lid outer walls, an insulating medium filling the space between said outer and said inner walls thereof, the outer and inner top, front and side walls of said lid and said lid insulating medium terminating along a common edge and being secured together to provide a waterproof insulated lid construction, said storage compartment being operable to contain liquid to the top edges of said side wall when resting on said bottom wall and to contain liquid to the top edge of said top wall when resting on said rear wall appendages, and a drain opening through the walls of said storage container and said storage compartment and said insulation adjacent to the edge defined by said rear and bottom walls to permit drainage of liquid from said storage compartment when resting on said bottom wall or said rear wall of said storage container.

2. A portable cooler according to claim 1 including hinge means securing said storage container and lid top walls together along the abutting edges thereof allowing the upward and downward movement of said lid where upon closing said lid, engagement of said tongue and said groove will provide good thermal insulation of said cooler and permitting said latching means of said lid and said storage container to be connected to enable transporting of said cooler as well as holding said lid securely to said storage container while providing good thermal insulation to said storage compartment.

* * * * *